US006371673B1

(12) United States Patent
Gueret

(10) Patent No.: US 6,371,673 B1
(45) Date of Patent: Apr. 16, 2002

(54) DISPENSER INCLUDING A PUSHER RETURNED TO AN INITIAL POSITION BY A TENSION MEMBER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/525,757

(22) Filed: Mar. 14, 2000

(30) Foreign Application Priority Data

Mar. 16, 1999 (FR) ..... 99 03213

(51) Int. Cl.[7] ..... A45D 40/06; A45D 40/10; A45D 40/24; B43K 21/08

(52) U.S. Cl. ..... 401/31; 401/68; 401/70; 401/75; 401/81

(58) Field of Search ..... 401/29–33, 70, 401/75, 76, 68, 98, 81

(56) References Cited

U.S. PATENT DOCUMENTS

| | | | | | |
|---|---|---|---|---|---|
| 1,447,727 | A | * | 3/1923 | Kendall | 401/31 X |
| 1,729,240 | A | * | 9/1929 | Augenstein | 401/32 |
| 2,130,345 | A | * | 9/1938 | Freeman | 401/31 |
| 2,526,089 | A | | 10/1950 | Shatkin | |
| 5,230,577 | A | * | 7/1993 | Cox et al. | 401/70 X |
| 5,423,623 | A | * | 6/1995 | Bakic | 401/70 |
| 5,547,300 | A | | 8/1996 | Powers | |
| 6,071,027 | A | * | 6/2000 | Gueret | 401/75 |

FOREIGN PATENT DOCUMENTS

| | | |
|---|---|---|
| FR | 2 589 696 A | 5/1987 |
| WO | WO 92/08387 A | 5/1992 |
| WO | WO 98 /9548 A | 3/1998 |

* cited by examiner

*Primary Examiner*—Gregory L. Huson
*Assistant Examiner*—Kathleen J. Prunner
(74) *Attorney, Agent, or Firm*—Oliff & Berridge, PLC

(57) ABSTRACT

A dispenser for a substance such as lipstick. The dispenser includes containing a pusher for the substance and a declutchable drive to move the pusher in an axial direction within the body to dispense the substance. The pusher returns to an initial position when the declutchable drive is declutched.

30 Claims, 5 Drawing Sheets

DISPENSER INCLUDING A PUSHER RETURNED TO AN INITIAL POSITION BY A TENSION MEMBER

The present invention relates to a dispenser of the type comprising a body within which a pusher is movable, declutchable drive means for driving said pusher in axial displacement so as to dispense a substance, and return means for returning the pusher into an initial position when said drive means are declutched.

BACKGROUND OF THE INVENTION

Such a dispenser is described in international application WO 98/09548.

OBJECTS AND SUMMARY OF THE INVENTION

An object of the invention is to improve a dispenser of that type.

In the dispenser of the invention the return means include a resilient member working in traction.

Advantageously, the resilient member is housed at least in part inside the pusher.

By means of the invention, the axial size of the dispenser can be reduced compared with that of the dispenser described in international application WO 98/09548, which makes use of a helical spring working in compression.

Advantageously, the resilient member is organized in such a manner as to damp the return movement of the pusher into its initial position.

This makes it possible for the structure of the dispenser to be simplified compared with that described in application WO 98/09548.

Preferably, the resilient member is fixed at one end to the end wall of the dispenser body and at its other end to the pusher.

In a particular embodiment, the pusher includes a notched or threaded rod extended at one end by a cylindrical portion of greater diameter than the rod, the resilient member being housed for the most part inside said cylindrical portion when the pusher is in its initial position.

In another particular embodiment, the pusher comprises a notched or threaded hollow rod within which the major portion of the resilient member is housed when the pusher is in its initial position.

In a particular embodiment, the pusher includes at least one portion of non-circularly-symmetrical section enabling it to be prevented from rotating and serving to guide it in a portion of the body of the dispenser.

In a particular embodiment, the body of the dispenser has first and second portions capable of rotating relative to each other. The pusher has a thread and is mounted with the ability to slide in the first portion of the body but without the ability to rotate relative to said first portion. The dispenser has drive means secured to the second portion of the body, said drive means comprising at least one drive member movable between a driving position in which it engages the thread of the pusher so that relative rotation between the two portions of the body causes the pusher to move axially, and a declutched position in which it ceases to be engaged with the thread of the pusher and enables the pusher to return to its initial position under the return action of the resilient member.

Advantageously, the two portions of the body are separable and are shaped so as to be engageable one in the other, the drive member being organized in such a manner that inserting one of the portions in the other portion causes the drive member to be displaced from its declutched position towards its drive position, and vice versa when said portions are separated.

Advantageously, the drive member is constituted by at least one resilient tab shaped to present a certain amount of resilience in the axial direction when it is engaged with the pusher, thereby enabling the pusher firstly to return slightly towards its initial position in the event of the user exerting axial thrust on the pusher while applying the substance, and secondly allowing the pusher to escape and return to its initial position or to a position closer to its initial position if said thrust exceeds a predetermined force.

Advantageously, the second portion of the body has a sliding element such as a piston or a cup slidably mounted in an axial passage of said second portion, the sliding element being releasably connected to the pusher by link means enabling the sliding element to be separated from the pusher when the first and second portions of the body are separated from each other.

In a particular embodiment, the link means comprise a jaw formed on one of the pusher and the sliding element, and a head formed on the other of the pusher and the sliding element, said jaw being shaped to clamp onto said head when the sliding element is engaged beyond a predetermined stroke inside said axial passage.

Advantageously, said resilient member is constituted by a coil spring.

The invention also provides a dual dispenser, comprising two dispensers as defined above, disposed in opposite directions.

This dual dispenser can be of axial size that is compatible with it being used as a makeup accessory, in particular because of the fact that each pusher is associated with a resilient member working in traction, thereby enabling it to be made more compact.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
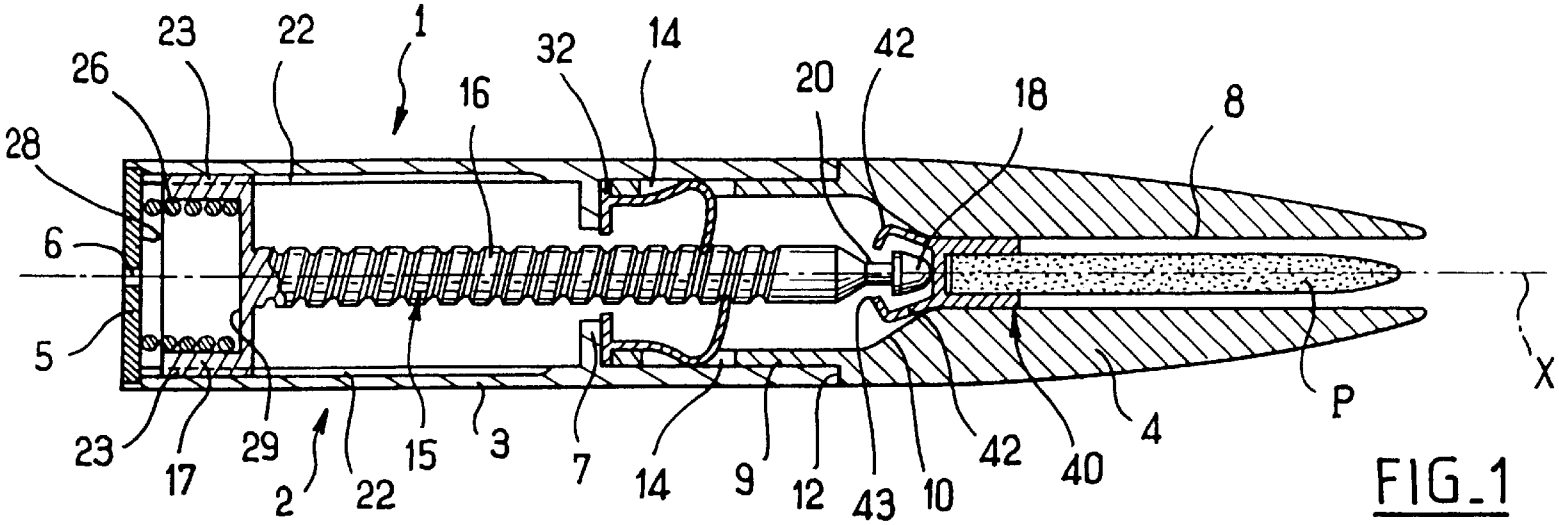
FIGS. 1 and 2 are two diagrammatic axial section views showing a dispenser constituting a first embodiment of the invention.
Figure 2:
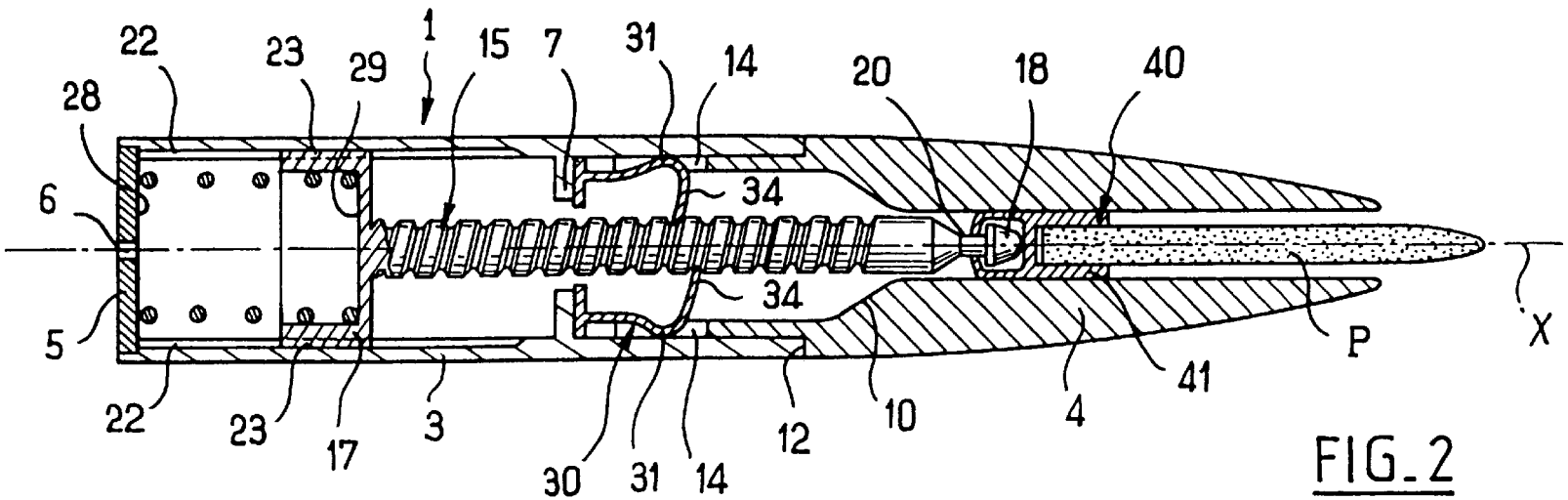
Figure 3:
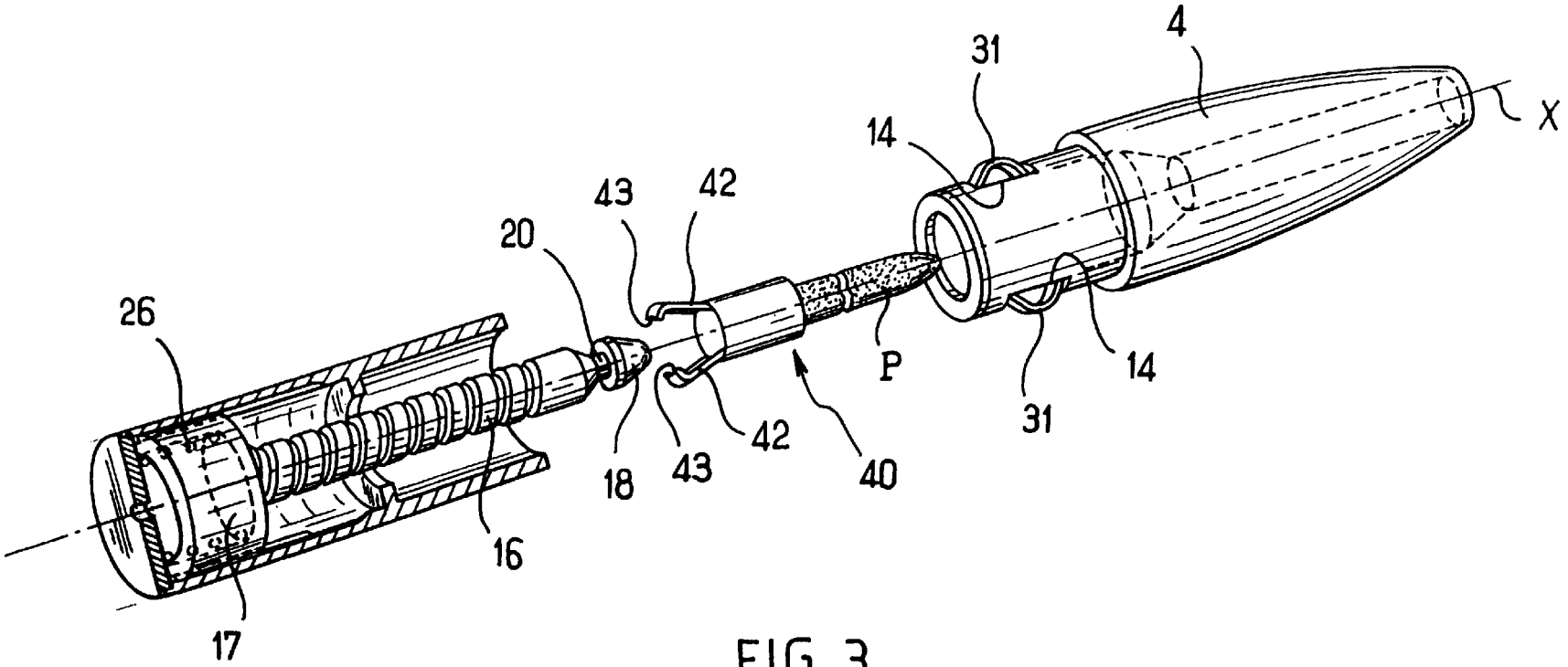
FIG. 3 is a diagrammatic, partially cutaway, exploded perspective view of the dispenser of FIGS. 1 and 2.

The dispenser 1 shown in FIGS. 1 and 2 comprises a body 2 that is generally elongate in shape along a longitudinal axis X.

The body 2 comprises two substantially tubular portions 3 and 4 that are capable of rotating relative to each other.

The first portion 3 is closed at one end by a plug 5 provided with a vent 6 and including an inside annular rib 7 whose function is described below.

The second portion 4 has an axial through passage 8 defining a housing for a supply of substance P that is in the form of a stick, for example.

The passage 8 is extended towards the first portion 3 of the body 2 of the dispenser via a conical mouth 10 whose function is explained below.

The second portion 4 of the body 2 is inserted in the first portion 3 and has an outside shoulder 12 against which the front end of the first portion 3 comes into abutment, as shown in FIGS. 1 and 2.

The rear end 9 of the second portion 4, engaged inside the first portion 3 is circularly cylindrical about the axis X and is provided with two diametrically opposite slots 14 (which can be seen in FIG. 5, in particular) whose function is described below.

The dispenser 1 also has a pusher 15 comprising a threaded rod 16.

The rear end of the pusher 15 is provided with a cylindrical portion 17 of greater diameter than the rod 16, and its front end is provided with an engagement portion constituted by a head 18 connected to the rod 16 via an annular groove 20.

The pusher 15 is slidably mounted in the first portion 3 of the body 2 and is prevented from rotating relative thereto by the facts firstly that the first portion 3 has at least two diametrically-opposite longitudinal grooves 22 in its inside surface extending between the plug 5 and the annular rib 7, and secondly that the cylindrical portion 17 has two ribs 23 shaped to slide in said grooves 22. In a variant that is not shown, it is also possible to prevent the pusher from rotating in the first portion 3 by using a pusher with a non-circularly-cylindrical section which would be a section of any whose shape that is not circularly symmetrical, for example square or oval.

A resilient member constituted in the example described by a coil spring 26 is provided to urge the pusher 15 so that it moves towards its initial position as shown in FIG. 1.

This spring 26 works in traction. Its rear end is fixed to the inside face 28 of the plug 5 and its front end is fixed to the end wall 29 of the cylindrical portion 17 of the pusher 15.

At rest, the turns of the spring 26 need not be completely touching and the length of the spring 26 can be slightly greater than that of the cylindrical portion 17 such that the spring 26 is not completely housed therein when the pusher 15 is in its initial position.

This ensures firstly that the total length of the dispenser is relatively short and secondly that the return motion of the pusher under drive from the spring 26 is damped.

The dispenser 1 has a drive member 30 enabling relative rotation between the first and second portions of the body 2 to be transformed into axial displacement of the pusher 15.

Figure 5:
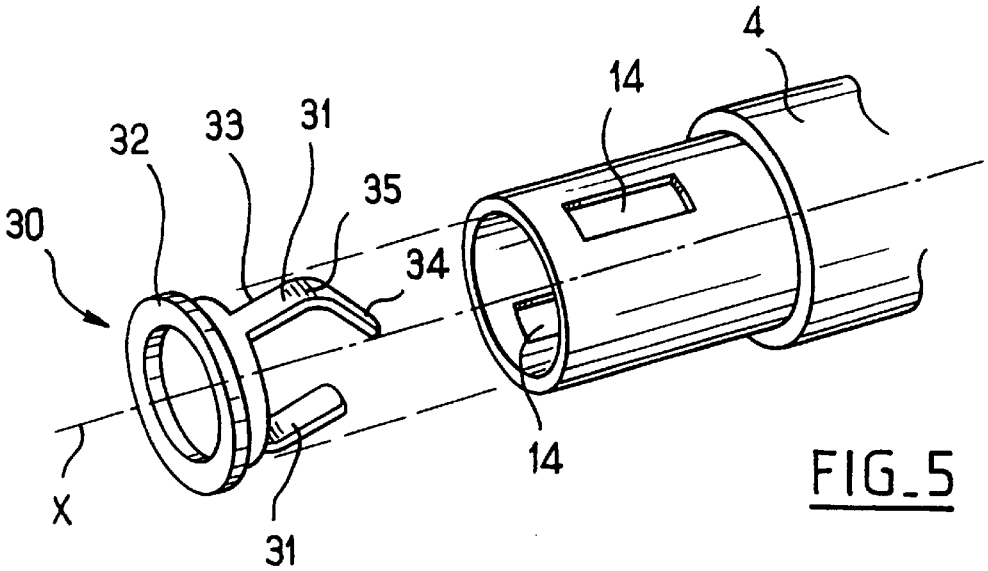
FIG. 5 shows a detail of the implementation of the drive means.
Figure 6:
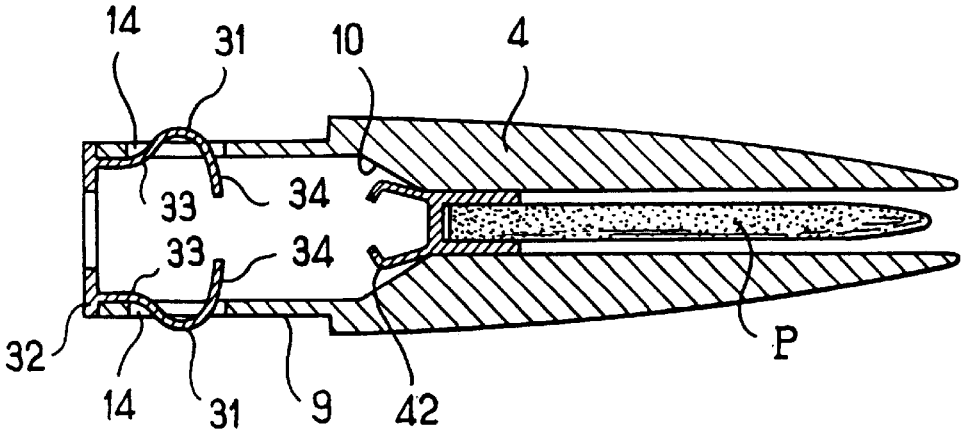
FIG. 6 shows the second portion of the body of the dispenser on its own.

This drive member 30 is shown on its own in FIG. 5 and in the example described it has two diametrically-opposite elastically-deformable tabs 31 that are interconnected by an annular base having an outwardly-directed shoulder so as to engage in the rear end of the second portion 4, as shown in FIG. 6. In a variant, the drive member 30 can have a single tab 31 only in which case the second portion need have only one corresponding slot 14.

Each tab 31 has a first portion 33 secured at one end to the annular base 32 and extending away therefrom while also extending away from the axis X. This first portion 31 is extended by a second portion 34 forming a bend 35 with the first portion and extending away therefrom while extending towards the axis X.

The bends 35 of the tabs 31 extend away from the slots 14 of the second portion 4 when the drive member 30 is in place while the first portion 3 is absent, as can be seen in FIG. 6.

The spacing between the free ends of the tabs 31 is then greater than the diameter of the rod 16.

The annular rib 7 serves to hold the annular base 32 pressed against the rear end of the second portion 4 when in its in-use position, as shown in FIG. 2.

A sliding element 40 is housed inside the passage 8 of the second portion 4.

Figure 10:
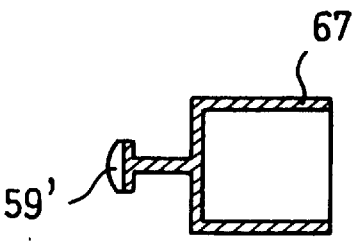
FIG. 10 is a diagram showing a variant embodiment of the sliding element.

The sliding element 40 has a cup 41 at its front end for supporting the stick of substance P, and at its rear end it has jaws 42 whose free ends 43 are spaced apart at rest by a distance which is greater than the largest diameter of the head 18. In a variant, the jaws 42 can be integrally formed with the pusher, and the head 59' can be integrally formed with the sliding element as shown in FIG. 10.

Figure 4:
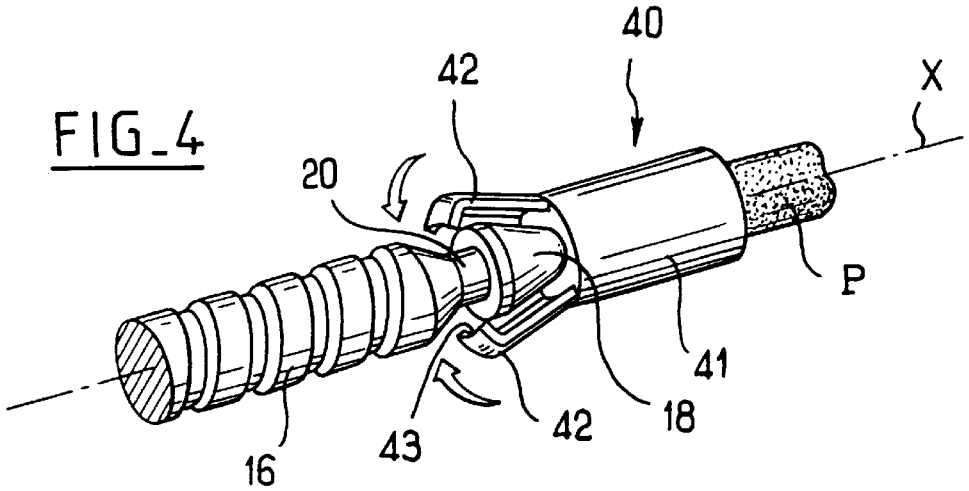
FIG. 4 shows the coupling between the pusher and the sliding element.

When the second portion 4 is inserted in the first portion 3, the head 18 can penetrate between the jaws 42 situated in the conical mouth 10, as shown in FIG. 4.

Once the first and second portions of the body 2 of the dispenser have been inserted one in the other, the pusher 15 is held in its initial position because of the presence of the spring 26.

During said insertion, the tabs 31 of the drive member 30 are pushed inwards and their free ends engage the rod 16.

The length of the stick of substance P is selected in such a manner that when the pusher 15 is in its initial position, its free end is set back slightly behind the nose of the second portion 4, as can be seen in FIG. 1.

When the second portion 4 is rotated relative to the first portion 3 in a given direction, the drive member 30 causes the pusher 15 to advance so that the sliding element 40 moves towards the outlet.

The jaws 42 close on the head 18, thereby enabling the sliding element 40 to be returned rearwards when the second portion 4 is rotated in the opposite direction.

The tabs 31 of the drive member present a certain amount of flexibility in the axial direction, thereby allowing the stick of substance P to be pushed in a little while it is being used.

At all times, the user can replace the second portion 4 by a new refill of substance or by a different substance, by separating the first portion 3 from the second portion 4, without it being necessary to cause the stick of substance to move out from the new refill.

During this operation, the jaws 42 of the sliding element 40 are returned to their initial position in the conical mouth 10, thereby enabling them to release the head 18.

Simultaneously, the tabs 31 of the drive member 30 move apart by being released from the slots 14, thereby releasing the rod 16 of the pusher 15 which is then returned to its initial position by the return effect of the spring 26. Because the spring 26 is affixed to the pusher 15 and the plug 5, the spring 26 exerts a return force on the pusher 15 as the pusher is moved to extend to the substance P. This return force increases as the elongation of the spring 26 increases.

Figure 7:
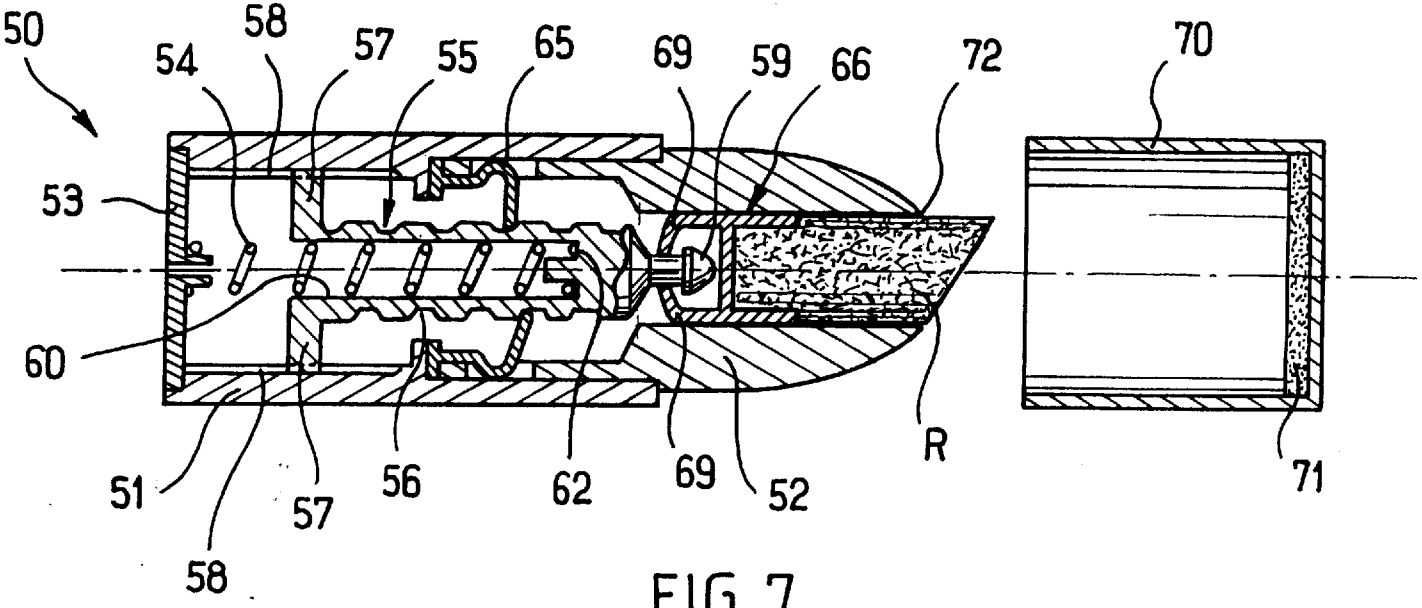
FIG. 7 is a diagrammatic axial section view of a dispenser constituting a second embodiment of the invention.

FIG. 7 shows a dispenser 50 constituting a second embodiment of the invention.

This dispenser comprises a first portion 51 and a second portion 52 which are analogous respectively to the first portion 3 and the second portion 4 of the dispenser 1 as described above.

The first portion 51 is closed at one end by a plug 53, with one end of a helical spring 54 that works in traction being fixed to the inside face thereof.

The dispenser 50 has a pusher 55 with an outside thread 56 over a portion of its length.

The rear end of the pusher 55 has fins 57 that slide in longitudinal grooves 58 of the first portion 51, and its front end has a head 59 similar to the head 18 of the above-described dispenser 1.

The front end 62 of the helical spring 54 is fixed to the end wall of a central bore 60 of the pusher 55.

When the pusher 55 is in its initial position, the fins 57 come to bear axially against the plug 53, and the spring 54 is housed entirely within the central bore 60.

The dispenser 50 has a drive member 65 identical to the drive member 30 of the above-described dispenser 1.

The second portion 52 of the dispenser 50 has a sliding element 66 which is organized to receive a stick of substance that is of relatively large diameter, for example a piece of lipstick R.

Figure 8:
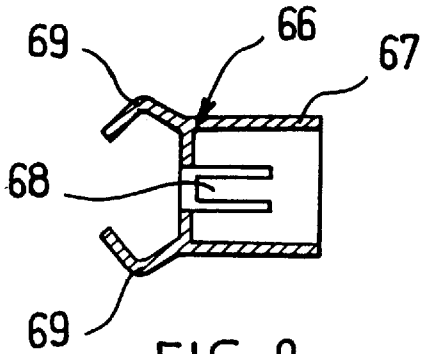
FIG. 8 shows the sliding element of the FIG. 7 dispenser on its own.

As can be seen in FIG. 8, the front of the sliding element 66 has a cup 67 provided with resilient tongues 68 projecting radially at rest into the cup 67, said tongues being intended to reinforce anchoring of the stick of substance R.

At the rear, the sliding element 66 has jaws 69 like the sliding element 40 in the preceding embodiment.

The sliding element 66 can also have an orifice in the end wall of the cup 67 so as to enable the substance to be cast from behind while hot.

The second portion 52 is shaped so as to enable a closure cap 70 to be engaged with its end wall being provided with a foam pad 71 against which the tip 72 of the second portion 52 comes to bear.

In general, because the return spring in the above-described examples is received at least in part in the pusher, it is possible for the dispenser to be relatively short in the axial direction.

Figure 9:
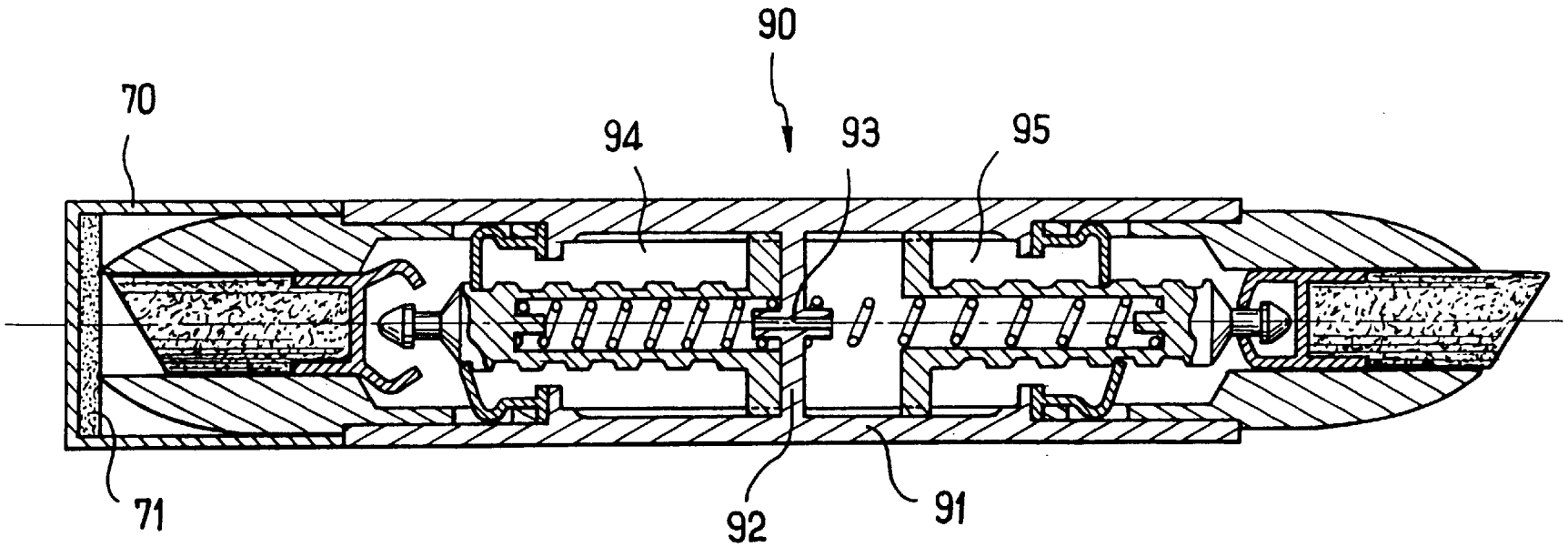
FIG. 9 is a diagram of a dual dispenser.

FIG. 9 shows a dual dispenser 90 whose body has a central portion 91 whose general structure is that which would be obtained by uniting the first portions 51 of two dispensers 50 mounted in opposite directions.

The plugs 53 are then replaced by a transverse wall 92 pierced by an orifice 93 so as to put into communication the compartments 94 and 95 in which the rear portions of the two pushers slide respectively.

In the embodiments described above, the spring used to return the corresponding pusher into its initial position is fixed by being welded at one end to said pusher and at its other end to the body of the dispenser. It would not go beyond the ambit of the invention to fix the spring by adhesive, with the end of the spring being hook-shaped, or for fixing to be implemented by suitable intermediate pieces.

Naturally, the invention is not limited to the embodiments shown.

In particular, without going beyond the ambit of the present invention, it is possible to use a resilient member other than a coil spring.

The stick of substance can be replaced by any other type of applicator such as a brush, a felt, a foam, or a piece of flocked material, and the substance can be a dye, a mascara, or eye shadow, for example.

In a variant that is not shown, the drive member can be constituted by a split nut.

Abutment-forming means as shown in figure 5d of application WO 98/09548 can be provided, where appropriate, for limiting rearward displacement of the sliding element.

What is claimed is:

1. A dispenser comprising a body within which a pusher is movable, declutchable drive means for driving said pusher in axial displacement so as to dispense a substance, and return means for returning the pusher into an initial position when said drive means are declutched, wherein said return means comprise a resilient member working in traction, said resilient member being mounted such that said resilient member is elongated so as to exert a return force on said pusher, as said pusher is moved to dispense the substance said return force increasing as the elongation of said resilient member increases.

2. A dispenser according to claim 1, wherein the tension member is housed at least in part inside the pusher.

3. A dispenser according to claim 1, wherein the tension member is organized in such a manner as to damp the return movement of the pusher into its initial position.

4. A dispenser according to claim 1, wherein the tension member is fixed at one end to the end wall of the dispenser body and at its other end to the pusher.

5. A dispenser according to claim 1, wherein the pusher includes a notched or threaded rod extended at one end by a cylindrical portion of greater diameter than the rod, the tension member being housed for the most part inside said cylindrical portion when the pusher is in its initial position.

6. A dispenser according to claim 1, wherein the pusher comprises a notched or threaded hollow rod within which the major portion of the tension member is housed when the pusher is in its initial position.

7. A dispenser according to claim 1, wherein the body of the dispenser has first and second portions capable of rotating relative to each other, wherein the pusher has a thread and is mounted with the ability to slide in the first portion of the body but without the ability to rotate relative to said first portion, and wherein the drive means is secured to the second portion of the body, said drive means comprising at least one drive member movable between a driving position in which it engages the thread of the pusher so that relative rotation between the two portions of the body causes the pusher to move axially, and a declutched position in which it ceases to be engaged with the thread of the pusher and enables the pusher to return to its initial position under the return forces of the tension member.

8. A dispenser according to claim 7, wherein the two portions of the body are separable and are shaped so as to be engageable one in the other, the drive member being organized in such a manner that inserting one of the portions in the other portion causes the drive member to be displaced from its declutched position towards its drive position, and vice versa when said portions are separated.

9. A dispenser according to claim 8, wherein the drive member is constituted by at least one resilient tab shaped to present a certain amount of resilience in the axial direction when it is engaged with the pusher, thereby enabling the pusher firstly to return slightly towards its initial position in the event of the user exerting axial thrust on the pusher while applying the substance, and secondly allowing the pusher to escape if said thrust exceeds a predetermined force.

10. A dispenser according to claim 8, wherein the second portion of the body has a sliding element slidably mounted in an axial passage of said second portion, the sliding element being releasably connected to the pusher by link means enabling the sliding element to be separated from the pusher when the first and second portions of the body are separated from each other.

11. A dispenser according to claim 10, wherein the link means comprise a jaw formed on one of the pusher and the sliding element, and a head formed on the other of the pusher and the sliding element, said jaw being shaped to clamp onto said head when the sliding element is engaged beyond a predetermined stroke inside said axial passage.

12. A dispenser according to claim 1, wherein said tension member is constituted by a coil spring.

13. A dispenser according to claim 1, wherein the pusher includes at least one portion of a non-circularly-cylindrical section enabling it to be prevented from rotating and serving to guide it in a portion of the body of the dispenser.

14. A dual dispenser, comprising two dispensers as defined in claim 1, disposed in opposite directions with a single body.

15. A dispenser comprising:

a body;

a pusher that is axially movable within the body, the pusher including a rod;

a declutchable drive member, the declutchable drive member being capable of engaging the rod and, thereby, driving the pusher in axial displacement to dispense a substance; and a resilient member working in traction engaging the pusher to return the pusher to an initial position when the declutchable drive member is declutched said resilient member being mounted such that said resilient member is elongated so as to exert a return force on said pusher as said pusher is moved to dispense the substance, said return force is increasing as the elongation of said resilient member increases.

16. The dispenser according to claim 15, wherein the resilient member is housed, at least in part, inside the pusher.

17. The dispenser according to claim 15, wherein the resilient member damps the return movement of the pusher into its initial position.

18. The dispenser according to claim 15, wherein the resilient member is fixed at one end to an end wall of the dispenser body, and at another end to the pusher.

19. The dispenser according to claim 15, wherein the rod is notched or threaded and has at one end a cylindrical portion of greater diameter than the remainder of the rod, the resilient member being housed, for the most part, inside the cylindrical portion when the pusher is in its initial position.

20. The dispenser according to claim 15, wherein the rod is notched or threaded and has a hollow portion within which the major portion of the resilient member is housed when the pusher is in its initial position.

21. The dispenser according to claim 15, wherein the body of the dispenser has a first portion and a second portion, the first portion being capable of being rotated relative to the second portion; the pusher has a thread and is mounted with the ability to slide in the first portion but without the ability to rotate relative to the first portion; and the declutchable drive member is movable between a driving position in which it engages the thread of the pusher so that relative rotation between the first portion and the second portion causes the pusher to move axially within the first body, and a declutched position in which the drive member ceases to be engaged with the thread of the pusher allowing the pusher to return to its initial position under a return force of the resilient member.

22. The dispenser according to claim 21, wherein the first portion and the second portion are separable and are shaped to be engageable with each other; and the drive member is arranged such that engaging the first portion and the second portion causes the drive member to be displaced from a declutched position towards a drive position, and separating the first portion and the second portion causes the drive member to be displaced from the drive position towards the declutched position.

23. The dispenser according to claim 22, wherein the drive member includes at least one resilient tab shaped to present resilience in the axial direction when the drive member is engaged with the pusher, the at least one resilient tab enabling the pusher to return slightly toward its initial position when a user exerts sufficient axial thrust on the pusher and allowing the pusher to escape if the axial thrust exceeds a predetermined force.

24. The dispenser according to claim 22, wherein the second portion has a sliding element slidably mounted in an axial passage of the second portion, the sliding element being releasably connected to the pusher by a jaw and a head enabling the sliding element to be separated from the pusher when the first portion and the second portion are separated from each other.

25. The dispenser according to claim 24, wherein the jaw is formed on one of the pusher and the sliding element, and the head is formed on the other of the pusher and the sliding element, the jaw being shaped to clamp onto the head when the jaw or head engages the sliding element beyond a predetermined stroke inside the axial passage.

26. The dispenser according to claim 15, wherein the resilient member is a coil spring.

27. The dispenser according to claim 15 wherein the pusher includes at least one portion of a non-circularly-cylindrical section enabling it to be prevented from rotating and serving to guide it in a portion of the body.

28. A dual dispenser, comprising two dispensers as defined in claim 15, disposed in opposite direction within a single body.

29. A dispenser comprising a body within which a pusher is movable, declutchable drive means for driving said pusher in axial displacement so as to dispense a substance, and return means for returning the pusher into an initial position when said drive means are declutched, wherein said return means comprise a resilient member working in traction, wherein the body of the dispenser has first and second portions capable of rotating relative to each other, wherein the pusher has a thread, the pusher is mounted with the ability to slide in the first portion of the body but without the ability to rotate relative to said first portion, and the drive means is secured to the second portion of the body, said drive means comprising at least one drive member movable between a driving position in which it engages the thread of the pusher so that relative rotation between the two portions of the body causes the pusher to move axially, and a declutched position in which it ceases to be engaged with the thread of the pusher and enables the pusher to return to its initial position under a return force of the resilient member, wherein the two portions of the body are separable and are shaped so as to be engageable one in the other, the drive member being organized in such a manner that inserting one of the portions in the other portion causes the drive member to be displaced from its declutched position towards its drive position, and vice versa when said portions are separated, and wherein the drive member comprises at least one resilient tab shaped to present a certain amount of resilience in the axial direction when it is engaged with the pusher, thereby enabling the pusher firstly to return slightly towards its initial position in the event of the user exerting axial thrust on the pusher while applying the substance, and secondly allowing the pusher to escape if said thrust exceeds a predetermined force.

30. A dispenser comprising:

a body;

a pusher that is axially movable within the body, the pusher including a rod;

a declutchable drive member, the declutchable drive member being capable of engaging the rod and, thereby, driving the pusher in axial displacement to dispense a substance; and a resilient member working in traction engaging the pusher to return the pusher to an initial position when the declutchable drive member is declutched, wherein the body of the dispenser has a first portion and a second portion, the first portion being capable of being rotated relative to the second portion; the pusher has a thread and is mounted with the ability to slide in the first portion but without the ability to rotate relative to the first portion; and the declutchable drive member is movable between a driving position in which it engages the thread of the pusher so that relative rotation between the first portion and the second portion causes the pusher to move axially within the body, and a declutched position in which the drive member ceases to be engaged with the thread of the pusher allowing the pusher to return to its initial position under a return of the resilient member, wherein the first portion and the second portion are separable and are shaped to be engageable with each other; and the drive member is arranged such that engaging the first portion and the second portion causes the drive member to be displaced from a declutched position towards a drive position, and separating the first portion and the second portion causes the drive member to be displaced from the drive position towards the declutched position and wherein the drive member includes at least one resilient tab shaped to present resilience in the axial direction when the drive member is engaged with the pusher, the at least one resilient tab enabling the pusher to return slightly toward its initial position when a user exerts sufficient axial thrust on the pusher and allowing the pusher escape if the axial thrust exceeds a predetermined force.

* * * * *